US007956589B1

(12) United States Patent
Fan

(10) Patent No.: US 7,956,589 B1
(45) Date of Patent: Jun. 7, 2011

(54) COMPENSATION NETWORK FOR ERROR AMPLIFIER OF A LOW DROPOUT REGULATOR

(75) Inventor: Jun Fan, Shanghai (CN)

(73) Assignee: Fairchild Semiconductor Corporation, San Jose, CA (US)

( * ) Notice: Subject to any disclaimer, the term of this patent is extended or adjusted under 35 U.S.C. 154(b) by 526 days.

(21) Appl. No.: 12/072,259

(22) Filed: Feb. 25, 2008

(51) Int. Cl.
*G05F 1/40* (2006.01)

(52) U.S. Cl. ..... 323/280; 323/274

(58) Field of Classification Search ..... 323/270, 323/273, 274, 275, 280, 281, 312–316
See application file for complete search history.

(56) References Cited

U.S. PATENT DOCUMENTS

| | | | | |
|---|---|---|---|---|
| 6,838,946 | B2 * | 1/2005 | Bazarjani | 331/16 |
| 7,106,033 | B1 * | 9/2006 | Liu et al. | 323/280 |
| 7,541,787 | B2 * | 6/2009 | Hayashi et al. | 323/281 |
| 7,710,091 | B2 * | 5/2010 | Huang | 323/280 |

OTHER PUBLICATIONS

Shi, C., et al., "A Highly Integrated Power Management IC for Advanced Mobile Applications" 2006, pp. 85-88, IEEE Custom Integrated Circuits Conference, CCIC.
Mattingly, D., "Designing Stable Compensation Networks for Single Phase Voltage Mode Buck Regulators" Dec. 2003, pp. 1-10, Intersil, Technical Brief.
Low Dropout Reguator—Wikipedia, the free encyclopedia, Jan. 2008, 2 pages, [retrieved on Jan. 21, 2008]. Retrieved from the internet: http://en.wikipedia.org/wiki/Low_dropout_regulator.

* cited by examiner

*Primary Examiner* — Jessica Han
(74) *Attorney, Agent, or Firm* — Okamoto & Benedicto LLP

(57) ABSTRACT

An error amplifier of a low dropout regulator includes a compensation network configured to adapt the error amplifier to varying load currents. The compensation network may be coupled to an amplifier stage of the error amplifier. For example, the compensation network may be coupled across an input and an output of the amplifier stage in a Miller connection. As another example, one end of compensation network may be coupled to an input of the amplifier stage with another end coupled to ground. The compensation network may have several resistors and capacitors that have corresponding parameter switches for switching the resistors and capacitors in and out of the compensation network to change a parameter of the compensation network based on load current.

19 Claims, 11 Drawing Sheets

COMPENSATION NETWORK FOR ERROR AMPLIFIER OF A LOW DROPOUT REGULATOR

BACKGROUND OF THE INVENTION

1. Field of the Invention

The present invention relates generally to electrical circuits, and more particularly but not exclusively to low dropout regulators.

2. Description of the Background Art

A low dropout (LDO) regulator is a linear DC voltage regulator with relatively small input-output differential voltage. A low dropout regulator typically includes an error amplifier driving an output transistor. The error amplifier compares the output voltage of the regulator with a reference voltage to generate a signal that controls the output transistor to maintain the output voltage within regulation requirement. The regulator's dropout voltage is the minimum voltage across the regulator required to maintain the output voltage at the correct level.

A compensation network may be used to stabilize the response of a low dropout regulator. Without a compensation network, the regulator may consume large quiescent current that may place internal poles of the transfer function ("pole") of the regulator to high frequency. Furthermore, without a compensation network, the regulator will only be stable in a narrow load current range.

A fixed RC (resistor-capacitor) compensation network is better than using no compensation network at all. However, with a fixed RC compensation network, a low dropout regulator may be unstable at load current extremes, such as with very low or very large load current. A typical fixed RC compensation network is only stable in a narrow current load range.

C. Shi, B. Walker, E. Zeisel, B. Hu, G. McAllister, "A Highly Integrated Power Management IC for Advanced Mobile Applications," IEEE 2006 Custom Intergrated Circuits Conference (CICC) discloses dynamic resistor compensation for a low dropout regulator. While potentially promising, dynamic resistor compensation is relatively difficult to realize in actual circuits, makes it relatively difficult to track load current, and introduces a very low pole in the error amplifier when load current is low, thereby adversely affecting power supply ripple rejection (PSRR).

SUMMARY

An error amplifier of a low dropout regulator includes a compensation network configured to adapt the error amplifier to varying load currents. The compensation network may be coupled to an amplifier stage of the error amplifier. For example, the compensation network may be coupled across an input and an output of the amplifier stage in a Miller connection. As another example, one end of compensation network may be coupled to an input of the amplifier stage with another end coupled to ground. The compensation network may have several resistors and capacitors that have corresponding parameter switches for switching the resistors and capacitors in and out of the compensation network to change a parameter of the compensation network based on load current.

These and other features of the present invention will be readily apparent to persons of ordinary skill in the art upon reading the entirety of this disclosure, which includes the accompanying drawings and claims.

The use of the same reference label in different drawings indicates the same or like components.

DETAILED DESCRIPTION

In the present disclosure, numerous specific details are provided, such as examples of circuits, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Figure 1:
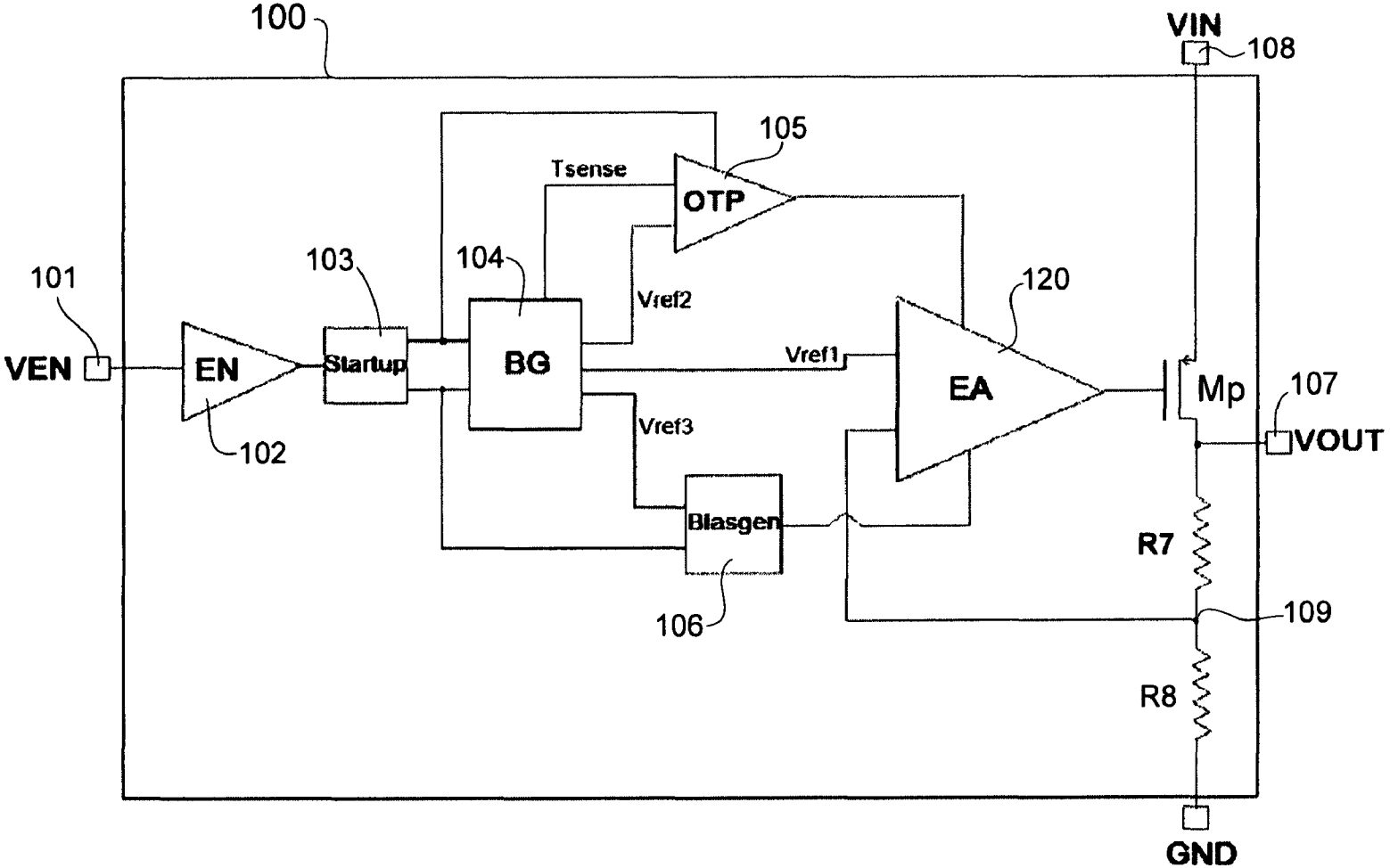
FIG. 1 schematically shows a low dropout regulator in accordance with an embodiment of the present invention.

FIG. 1 schematically shows a low dropout (LDO) regulator 100 in accordance with an embodiment of the present invention. As will be more apparent below, a differential error amplifier 120 of the regulator 100 includes a novel compensation network that stabilizes the response of the regulator 100 across a wide range of load currents.

In the example of FIG. 1, the regulator 100 receives an input voltage VIN at a node 108 to generate an output voltage VOUT at a node 107. The error amplifier 120 monitors the output voltage VOUT by way of a voltage divider network comprising resistors R7 and R8. The error amplifier 120 compares the monitored output voltage to a stable reference voltage Vref1 to generate a control signal that drives an output stage comprising the power transistor Mp such that the output voltage VOUT is within regulation requirement. For example, the input voltage VIN may be about 1.4V to 3.6V. In that case, the output voltage VOUT may be maintained by the regulator 100 to be in the range of about 1.2V to 3.4V.

An enable signal VEN may be applied at a node 101 to enable the operation of the regulator 100. The enable signal VEN may be applied to a startup circuit 103 by way of a buffer 102. The startup circuit 103 generates signals to start the bandgap (BG) reference circuit 104, the over temperature protection (OTP) circuit 105, and the bias generator 106 in a controlled fashion. The reference circuit 104 is configured to generate reference voltages Vref1, Vref2, and Vref3. The error amplifier 120 uses the reference voltage Vref1 for comparison with the monitored output voltage at the node 109.

The OTP circuit 105 receives the reference voltage Vref2 for comparison with the temperature sense signal Tsense to generate an enable signal to the error amplifier 120. The OTP circuit 105 is configured to disable the error amplifier 120 when its temperature is higher than a high temperature limit (e.g., about 150° C.). The bias generator 106 uses the reference voltage Vref3 to generate a temperature-independent current for the error amplifier 120.

Figure 2:
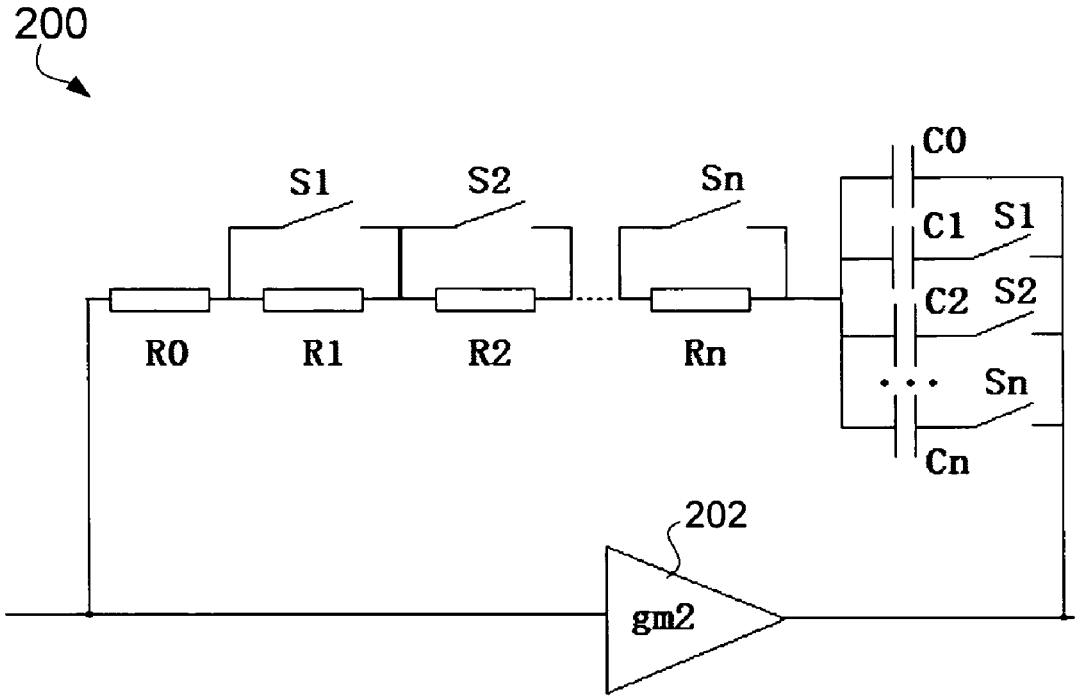
FIG. 2 shows a compensation network for an error amplifier of a low dropout regulator in accordance with an embodiment of the present invention.

Referring now to FIG. 2, there is shown a compensation network 200 in accordance with an embodiment of the present invention. In the example of FIG. 2, the compensation network 200 includes controllable parameter switches S1, S2, . . . , Sn to switch in or out corresponding resistors and/or capacitors to change the parameters of the network 200 to adapt to varying load current, i.e., output current supplied to the load. In one embodiment, a parameter switch for a resistor is ganged with a corresponding parameter switch for a capacitor. For example, switches S1 for resistor R1 and capacitor C1 may be switched together, switches S1 for resistor R2 and capacitor C2 may be switched together, and so on. The resistor R0 and capacitor C0, which are not switched, provide a fixed RC network when all the parameter switches are open, such as when load currents are low.

In the example of FIG. 2, the amplifier 202 is one stage of the error amplifier 120 of the low dropout regulator 100 (see FIG. 1). The switching of each parameter switch may be controlled by a corresponding switch control signal. In one embodiment, n number of control signals, one for each parameter switch, is generated (see FIG. 3) to change the parameters of the compensation network 200. In effect, by opening and closing, each parameter switch switches in and out a corresponding resistor or capacitor to adapt the error amplifier 120 to varying load currents. When the load current is low, all n parameter switches may be opened to have the effective resistor of the compensation network to be at its maximum value. The zero of the transfer function ("zero") of the regulator 120 is low enough to compensate for the low load current.

With increasing load current, the parameter switches are selectively closed, such as one at a time from S1 to S2 to S3 and so on, to decrease the value of the effective resistor and place the zero to high frequency. The position of the pole can also be adjusted by controlling the opening and closing of the parameter switches to change the value of the effective capacitor of the compensation network 200.

As a particular example, the capacitance values may be C0=4 pF, C1=C2=C3=C4=0 and the resistance values may be R0=50 k, R1=800K, R2=400 k, R3=200 k, R4=100K, with the switches S1 to S4 triggering to close when the load current reaches 2 mA, 20 mA, 40 mA, 80 mA, respectively. More specifically, the switches S1 for the resistor R1 and capacitor C1 may be closed when the load current is 2 mA and larger, the switches S2 for the resistor R2 and the capacitor C2 may be triggered to close when the load current is 20 mA and larger, and so on. The parameter switches are opened when the load current is below their respective triggering points. The resistor and capacitor values and the trigger points for closing them may be varied depending on the particulars of the application.

Figure 3:
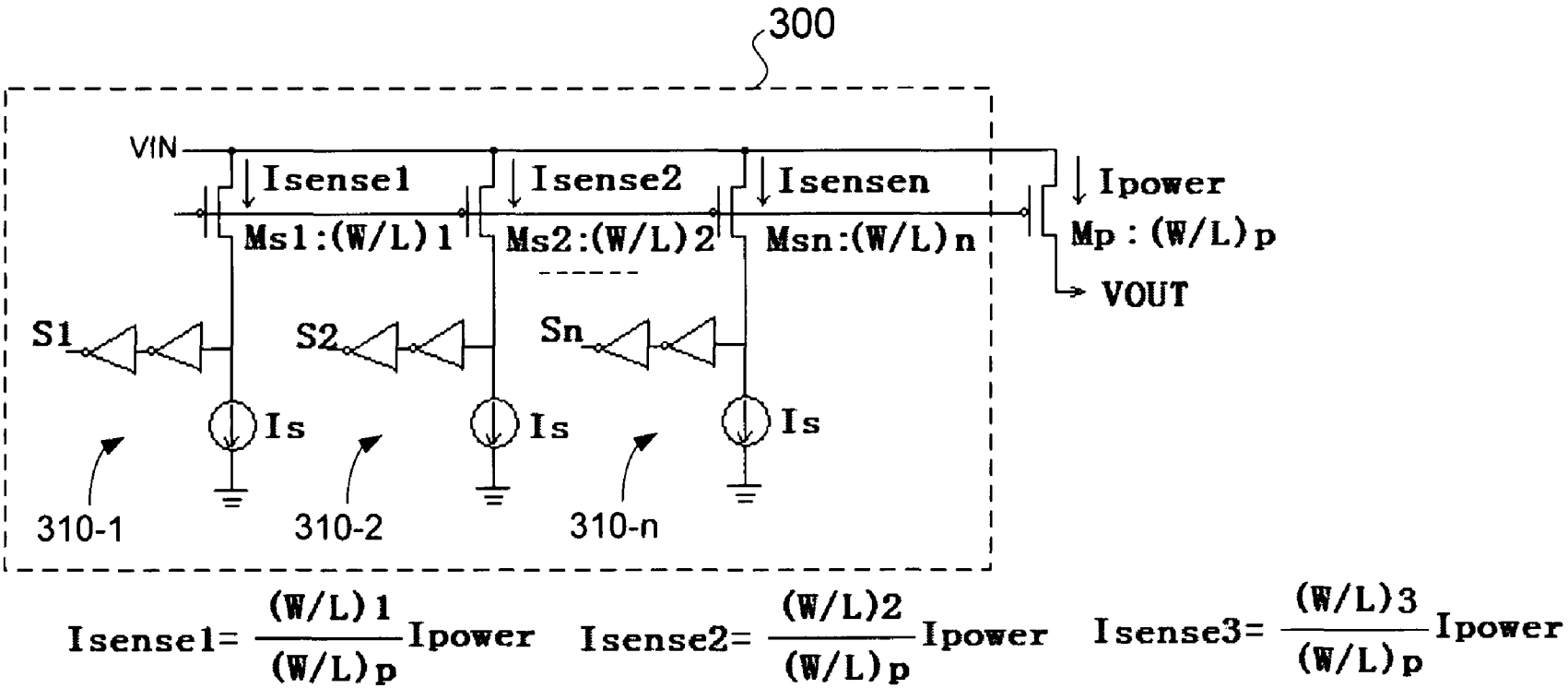
FIG. 3 shows a load current monitoring and parameter switch control circuit in accordance with an embodiment of the present invention.

FIG. 3 shows a load current monitoring and parameter switch control circuit 300 in accordance with an embodiment of the present invention. As its name implies, the circuit 300 is configured to monitor electrical current supplied to the load by the low dropout regulator 100 and, based on the monitored load current, control the opening and closing of the parameter switches S1, S2, . . . , Sn of the compensation network 200. As discussed, a parameter switch may be closed when the load current is at or above a triggering point to effectively remove a component (e.g., resistor and/or capacitor) from the compensation network, and opened when below the triggering point to effectively insert the component into the compensation network.

The circuit 300 may include a plurality of sense current blocks 310 (i.e., 310-1, 310-2, . . . , **310-*n*), one for each parameter switch. Each current sense block 310** may have a different, increasing triggering point such that as the load current increases, a first parameter switch is closed at a first output current value, a second parameter switch is closed at a second output value greater than the first output value while the first parameter switch remains closed, and so on. With decreasing load current, the second parameter switch is opened just below the second triggering point, and the first parameter switch is opened just below the first triggering point with the second parameter switch remaining open.

In the example of FIG. 3, the circuit 300 is configured as a current mirror to sense the load current. More specifically, a current Isense flowing through a sense transistor Ms of a sense current block 310 is indicative of the current Ipower supplied to the load by way of the output power transistor Mp. In one embodiment, n parameter switches use n current sense blocks 310. The relationship between currents (sense and Ipower for each current sense block 310 is also shown in FIG. 3.

In operation, a sense current Isense (i.e., Isense1, Isense2, . . . , Isensen) is compared to a constant current source Is. The result of the comparison is then sent to the compensation network 200 to control the corresponding parameter switch. In the example of FIG. 3, "W/L" represents the width over length ratio of the sense transistors Ms (i.e., Ms1, Ms2, . . . , Msn) and the output transistor Mp. The size of the sense transistors Ms may be configured to achieve a particular trigger point. FIG. 3 also shows the relationship between currents Isense and Ipower for each of the current sense blocks 310. The transistors Ms are PMOS transistors in this and other examples herein for illustration purposes only.

Figure 4:
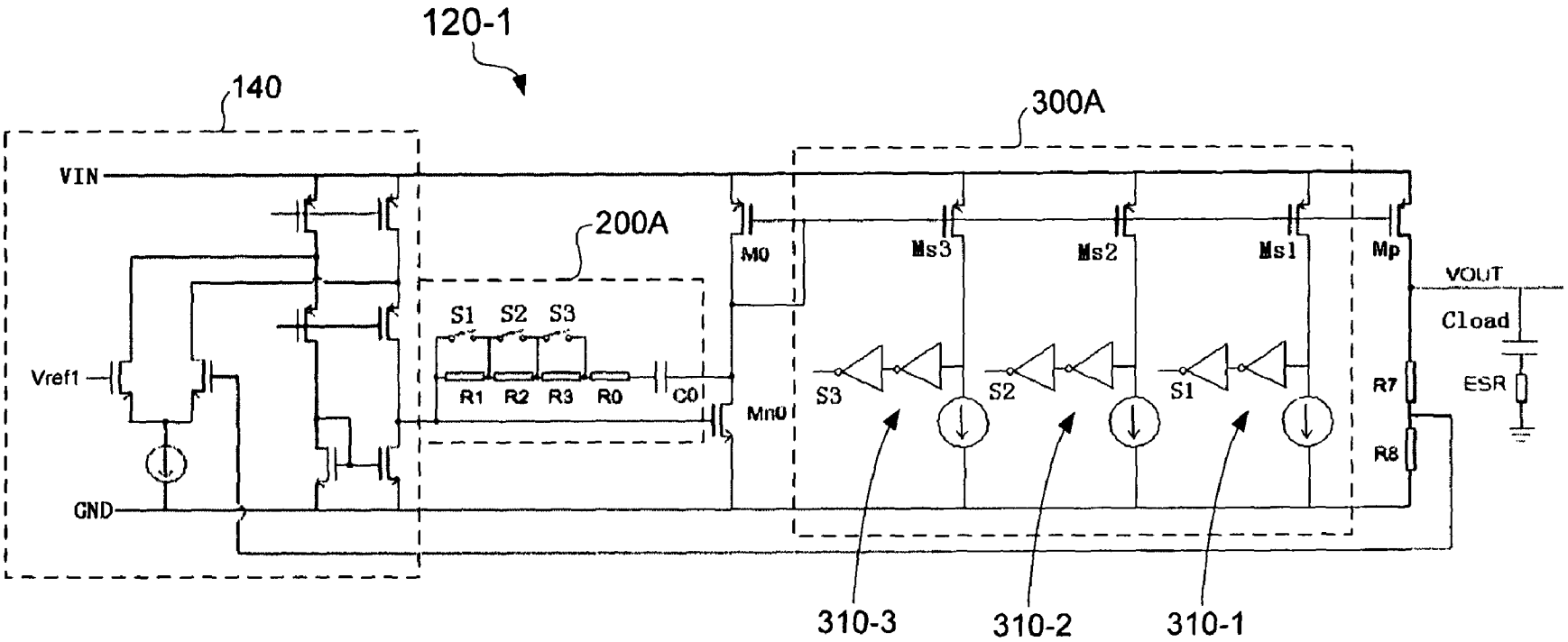
FIG. 4 shows a schematic diagram of an error amplifier of a low dropout regulator in accordance with an embodiment of the present invention.

FIG. 4 shows a schematic diagram of an error amplifier 120-1 in accordance with an embodiment of the present invention. The error amplifier 120-1 is a particular embodiment of the error amplifier 120 (FIG. 1). The error amplifier 120-1 may thus be used as the error amplifier of the low dropout regulator 100. FIG. 4 also shows the load capacitor (Cload) and effective series resistance (ESR) at the output.

In the example of FIG. 4, the error amplifier 120-1 includes a signal comparison circuit 140 comprising a differential amplifier with one input coupled to the reference signal Vref1 (see also FIG. 1) and another input coupled to monitor the output voltage VOUT by way of the voltage divider comprising the resistors R7 and R8 (see also node 109 in FIG. 1).

The output of the comparison circuit 140 is coupled to the compensation network 200A, which is a particular embodiment of the compensation network 200 (FIG. 2). The compensation network 200A includes resistors R1, R2, R3, R0, and a capacitor C0 in a Miller connection with an amplifier stage comprising a transistor Mn0. A transistor M0 is the active load of the amplifier stage.

Each of the resistors R1, R2, and R3 of the compensation network 200A has a corresponding parameter switch for switching the resistor in or out of the compensation network 200A. This allows adjustment of the parameters of the network 200A to adapt to varying load current. In the example of FIG. 4, the compensation network 200A has a single capacitor C0. More or less transistors and capacitors, with corresponding parameter switches, may be employed depending on the application.

In the example of FIG. 4, a load current monitoring and control circuit 300A is a specific embodiment of the circuit 300 (FIG. 3). The circuit 300A generates control signals S1, S2, and S3 to control corresponding parameter switches in the compensation network 200A. That is, control signal S1 of the sense block 310-1 controls the switching of the parameter switch S1 across the resistor R1, control signal S2 of the sense block 310-2 controls the switching of the parameter switch S2 across the resistor R2, and control signal S3 of the sense block 310-3 controls the switching of the parameter switch S3 across the resistor R3. Three sense blocks 310 are shown to accommodate three parameter switches. The circuit 300A is otherwise the same and operates in the same manner as the circuit 300 of FIG. 3. The circuit 300A monitors load current and generates a corresponding control signal to control the opening and closing of the parameter switches across the resistors R1, R2, and R3. This allows for adjustment of the parameters of the compensation network 200A in response to varying load current, allowing for regulator stability over a wide range of load currents.

Figure 5:
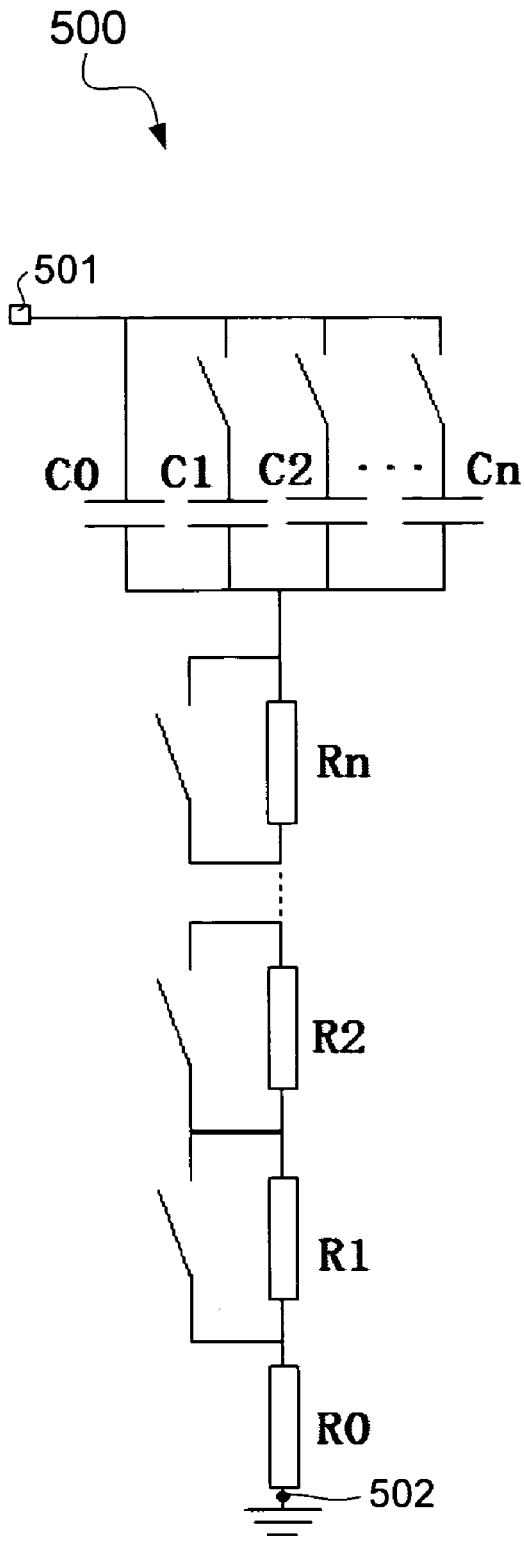
FIG. 5 shows a compensation network for an error amplifier of a low dropout regulator in accordance with another embodiment of the present invention.

In the example of FIGS. 3 and 4, the compensation network is coupled from input to output of an amplifier stage, i.e., in a Miller connection. Depending on the amplifiers employed, a compensation network in accordance with an embodiment of the present invention may also be connected with one node connected to ground. This is shown in FIG. 5, where the compensation network 500 is connected with a node 501 connected to an input of an amplifier stage and opposite node 502 connected to ground. Either end of the compensation network 500 may be connected to ground or input of an amplifier stage depending on the application. As in the compensation network 200 (FIG. 2), the compensation network 500 includes controllable parameter switches for adjusting the parameters of the compensation network 500 by switching in and out resistors R1, R2, . . . , Rn and capacitors C1, C2, . . . , Cn. Like the compensation network 200, the parameter switches of the compensation network 500 may be controlled by the circuit 300 (FIG. 3).

Figure 6:
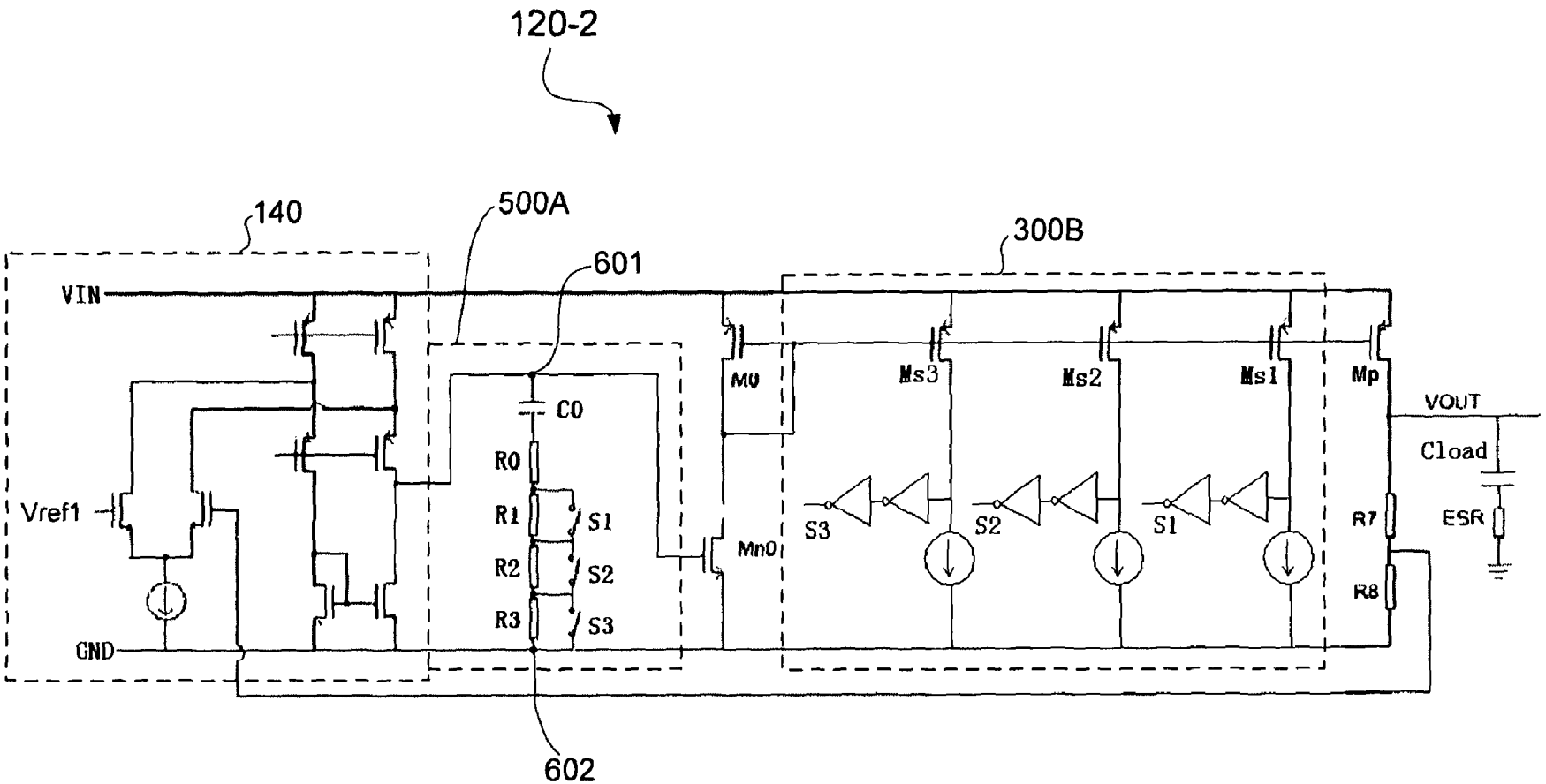
FIG. 6 schematically shows an error amplifier of a low dropout regulator in accordance with another embodiment of the present invention.

FIG. 6 schematically shows an error amplifier 120-2 in accordance with an embodiment of the present invention. The error amplifier 102-2 is the same as the error amplifier 120-1 except for the use of a compensation network 500A. Same as the error amplifier 120-1, the error amplifier 120-2 includes the signal comparison circuit 140 comprising a differential amplifier with one input coupled to the reference signal Vref1 (see also FIG. 1) and another input coupled to monitor the output voltage VOUT by way of the voltage divider comprising the resistors R7 and R8 (see also node 109 in FIG. 1).

In the example of FIG. 6, the output of the comparison circuit 140 is coupled to the compensation network 500A, which is a particular embodiment of the compensation network 500 (FIG. 5). The compensation network 500A includes resistors R1, R2, R3, R0, and a capacitor C0, with a node 601 connected to an input of the amplifier stage comprising the transistor Mn0 and an opposite node 602 connected to ground. The transistor M0 is the active load of the amplifier stage comprising the transistor Mn0.

Each of the resistors R1, R2, and R3 of the compensation network 500A has a corresponding parameter switch for switching the resistor in or out of the compensation network 500A. This allows adjustment of the parameters of the network 500A to adapt to varying load current. In the example of FIG. 6, the compensation network 500A has a single capacitor C0. More or less transistors and capacitors, with corresponding parameter switches, may be employed depending on the application.

As in the error amplifier 120-1, a load current monitoring and control circuit 300B is a specific embodiment of the circuit 300 (FIG. 3). The circuit 300B generates control signals S1, S2, and S3 to control corresponding parameter switches in the compensation network 500A. That is, control signal S1 of the sense block 310-1 controls the switching of the parameter switch S1 across the resistor R1, control signal S2 of the sense block 310-2 controls the switching of the parameter switch S2 across the resistor R2, and control signal S3 of the sense block 310-3 controls the switching of the parameter switch S3 across the resistor R3. Three sense blocks 310 are shown to accommodate three parameter switches. The circuit 300B is otherwise the same and operates in the same manner as the circuit 300 of FIG. 3. The circuit 300B monitors load current and generates a corresponding control signal to control the opening and closing of the parameter switches across the resistors R1, R2, and R3. This allows for adjustment of the parameters of the compensation network 500A in response to varying load current, allowing for regulator stability over a wide range of load currents.

Figure 7:
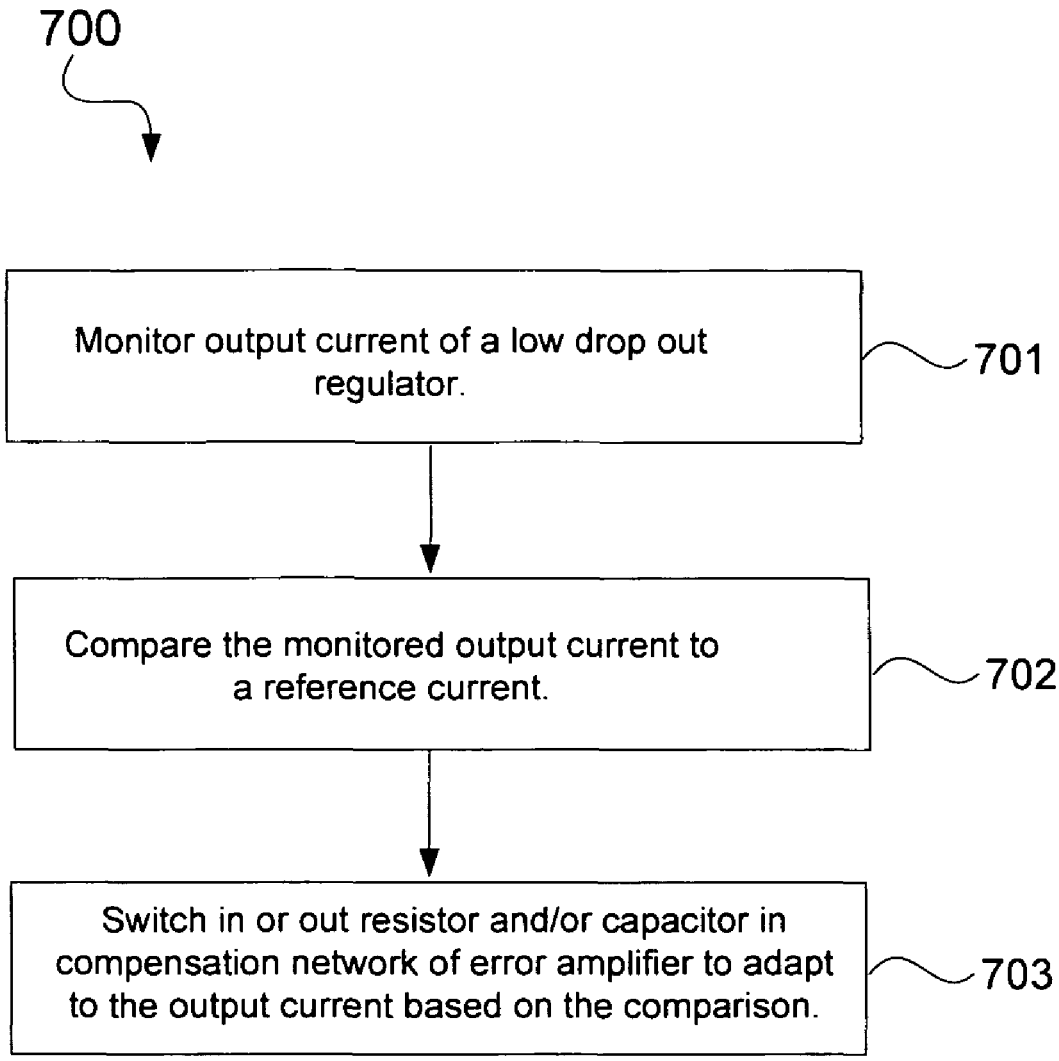
FIG. 7 shows a flow diagram of a method of providing compensation for an error amplifier of a low dropout regulator in accordance with an embodiment of the present invention.

Referring now to FIG. 7, there is shown a flow diagram of a method 700 of providing compensation for an error amplifier of a low dropout regulator in accordance with an embodiment of the present invention.

In step 700, a current monitoring and control circuit monitors the output current of the low dropout regulator. For example, the current monitoring and control circuit 300 of FIG. 3 may be used to monitor the output current delivered to the load by the low dropout regulator.

In step 702, the current monitoring and control circuit may compare the monitored output current to a reference current. For example, the current monitoring and control circuit 300 may compare the monitored output current to a current reference and develop a corresponding control signal. The current monitoring and control circuit may have a plurality of current sense blocks, with each current sense block comparing the monitored output current to a reference current.

In step 703, the current monitoring and control circuit sets the control signal active or inactive to switch close or open a parameter switch across a resistor and/or capacitor in the compensation network depending on the result of the comparison. This allows the parameters of the compensation network to be adjusted based on the load current. For example, the current monitoring and control circuit may place the control signal active to close a parameter switch when the comparison indicates that the load current is equal to or greater than a current threshold used as a triggering point. Conversely, the current monitoring and control circuit may place the control signal inactive to open the parameter switch when the comparison indicates that the load current is less than the current threshold. The plurality of current sense blocks may each have different current thresholds to generate a separate control signal for different parameter switches across different resistors and/or capacitors.

Figure 8:
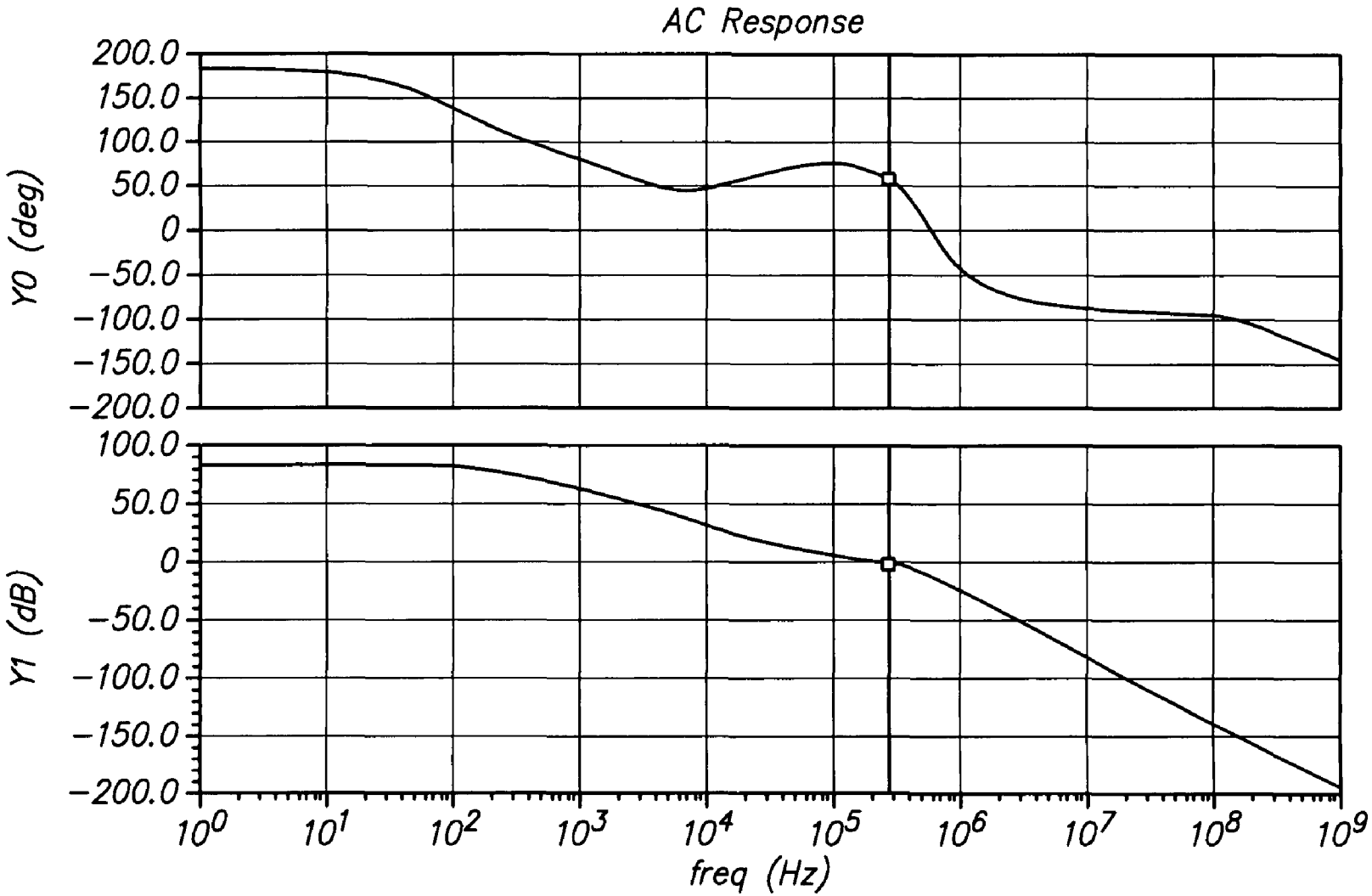
FIGS. 8-11 show gain and phase plots illustrating the AC response of a low dropout regulator without a compensation network in its error amplifier.
Figure 9:
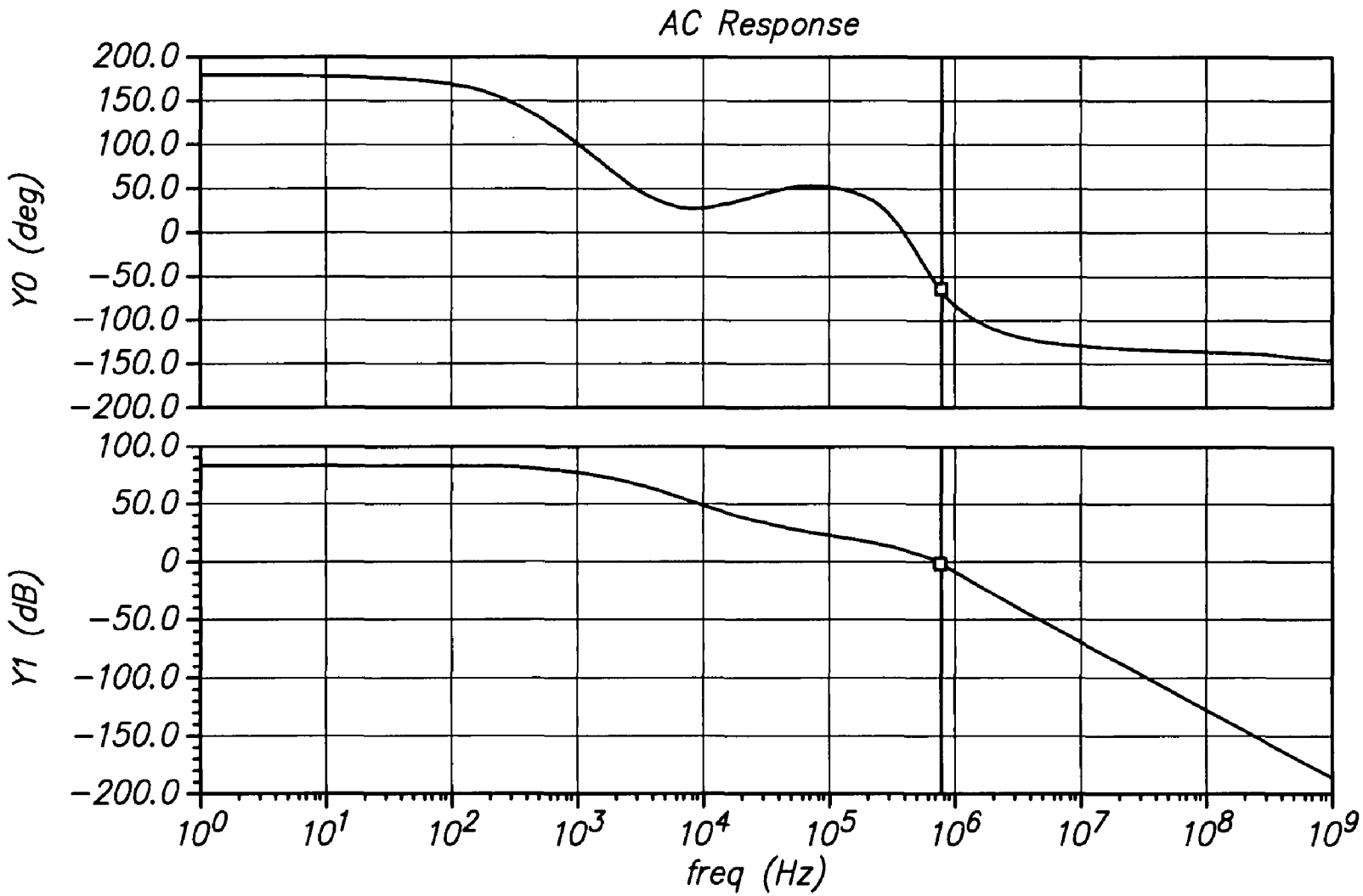
Figure 10:
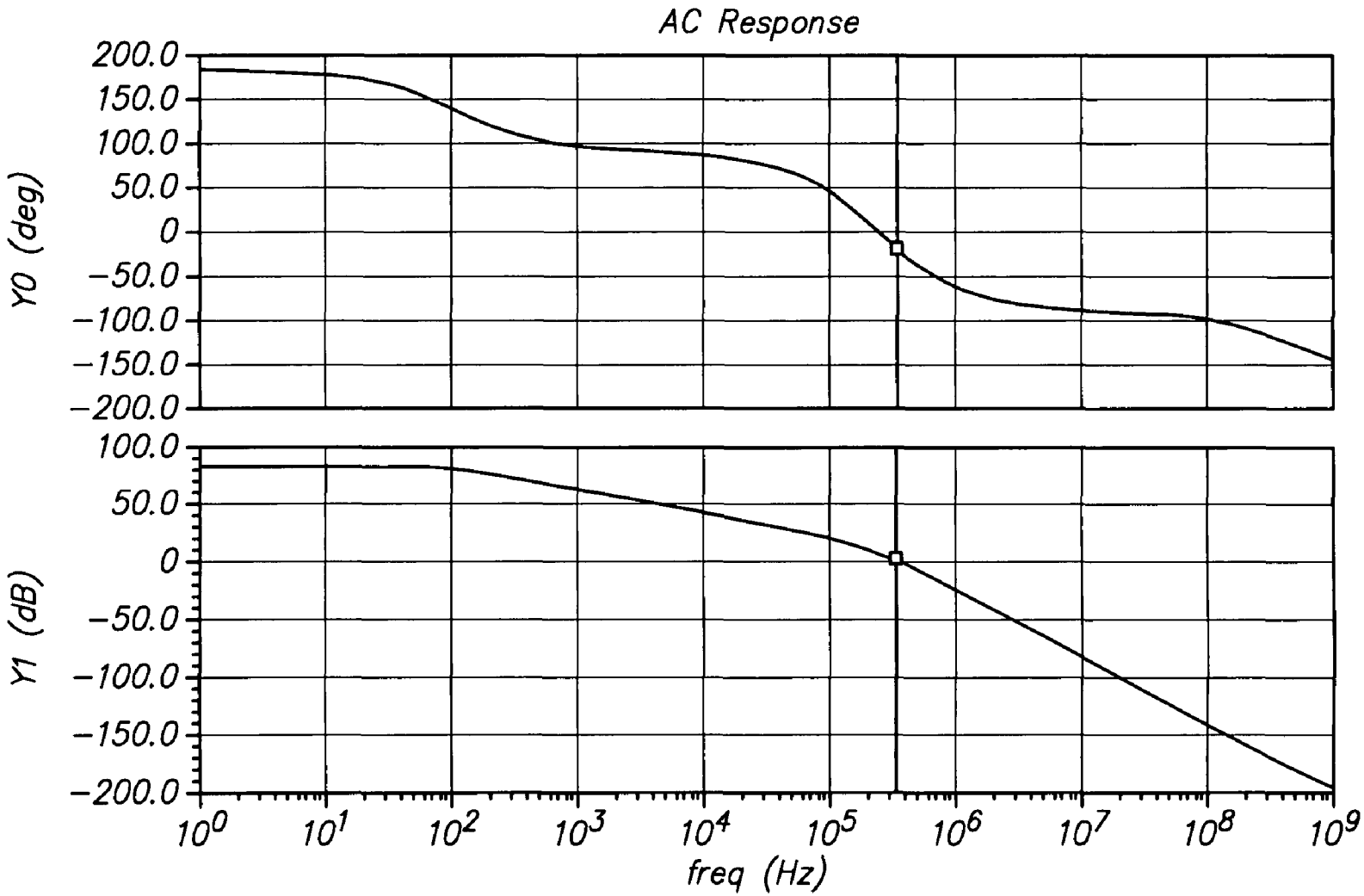
Figure 11:
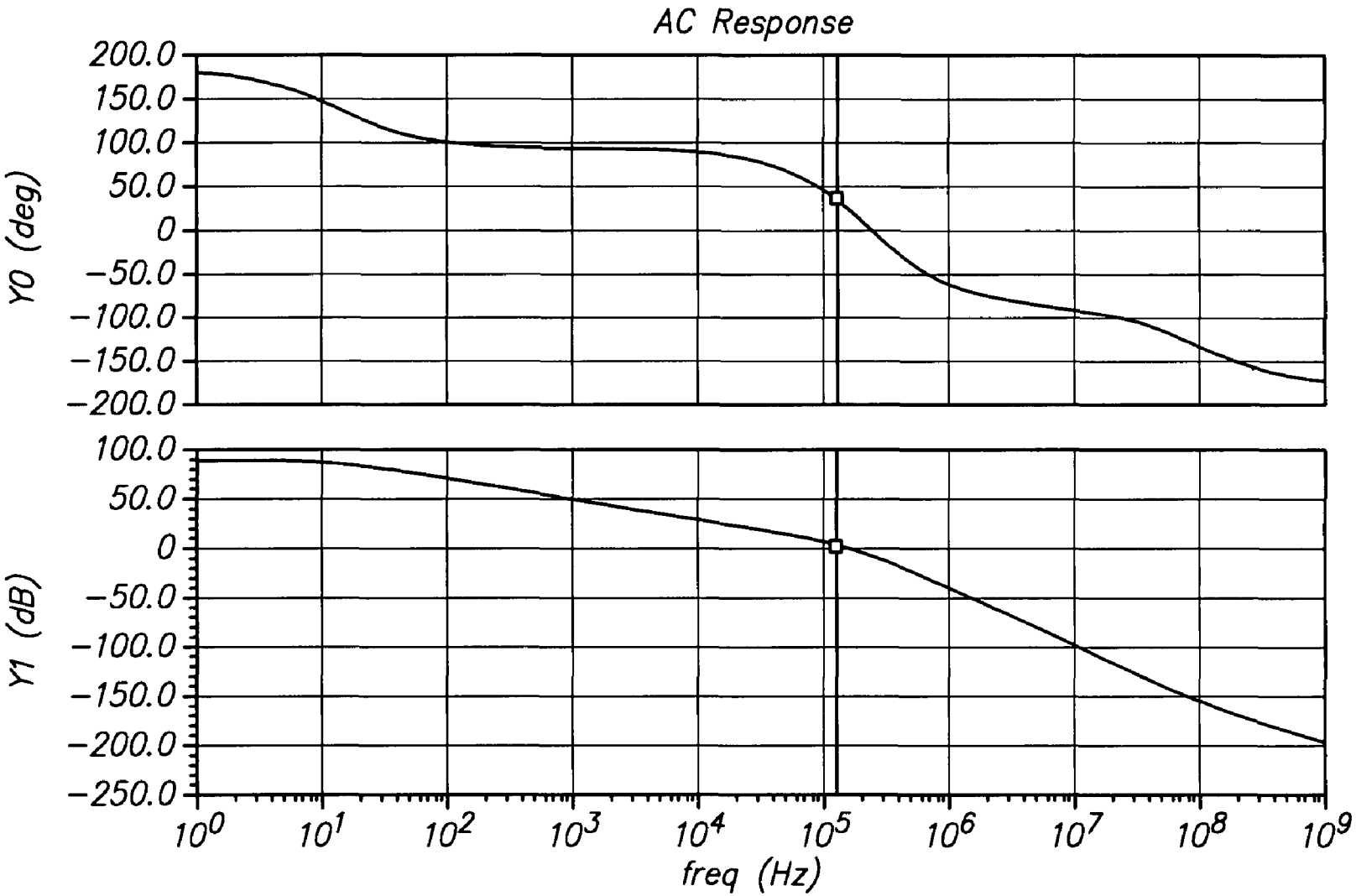

As can be appreciated, embodiments of the present invention provide a practical and effective adjustable compensation network for error amplifiers of low dropout regulators. FIGS. 8-11 show gain and phase plots illustrating the AC response of a low dropout regulator without a compensation network in its error amplifier. In FIGS. 8-11, the top plot shows phase versus frequency, while the bottom plot shows gain versus frequency. The low dropout regulator may be configured to be stable at low load currents as shown in FIG. 8, but not stable at large load current as shown in FIG. 9. The low dropout regulator may also be configured such that it is not stable at low load current as shown in FIG. 10, but stable at large load current as shown in FIG. 11. While the low dropout regulator can be made stable at low load current or large load current without compensation in its error amplifier, the low dropout regulator cannot be made stable at both low and large current conditions. The practical and effective adjustable compensation network disclosed herein is thus especially beneficial in error amplifiers of low dropout regulators.

While specific embodiments of the present invention have been provided, it is to be understood that these embodiments are for illustration purposes and not limiting. Many additional embodiments will be apparent to persons of ordinary skill in the art reading this disclosure.

What is claimed is:

1. An error amplifier of a low dropout regulator, the error amplifier comprising:

a differential amplifier configured to compare a reference signal to a monitored output signal indicative of an output of the low dropout regulator;

a compensation network coupled to an output of the differential amplifier, the compensation network comprising a plurality of resistors and a plurality of switches, the plurality of resistors being coupled to an intermediate amplifier stage of the error amplifier of the low drop out regulator, each resistor in the plurality of resistors having a corresponding switch in the plurality of switches across the resistor; and a control circuit configured to generate a separate control signal for each switch in the plurality of switches to control switching of the plurality of switches to adjust parameters of the compensation network based on a monitored load current of the low drop out regulator.

2. The error amplifier of claim 1 wherein the compensation network is coupled across an input and an output of the intermediate amplifier stage in a Miller connection.

3. The error amplifier of claim 1 wherein a first end of the compensation network is coupled to an input of the intermediate amplifier stage and a second end of the compensation network opposite the first end is coupled to ground.

4. The error amplifier of claim 1 wherein the compensation network further comprises a plurality of capacitors, each of the capacitors having a corresponding switch across the capacitor that is controlled together with a switch across a resistor in the plurality of resistors.

5. The error amplifier of claim 1 wherein the control circuit is coupled to an output of the intermediate amplifier stage.

6. The error amplifier of claim 1 wherein the control circuit comprises a plurality of current sense blocks configured to compare the monitored load current to a current threshold.

7. The error amplifier of claim 6 wherein each of the current sense blocks controls a corresponding switch in the compensation network.

8. The error amplifier of claim 1 wherein the current threshold is provided by a constant current source.

9. The error amplifier of claim 1 wherein the monitored output signal indicative of the output of the low dropout regulator is sampled from a node of a voltage divider comprising of at least two resistors.

10. A method of providing compensation for an error amplifier of a low dropout regulator, the method comprising:

monitoring an output current of the low dropout regulator;

comparing the monitored output current to a first current reference and a second current reference;

switching a first resistor of a compensation network of the error amplifier in or out of the compensation network to change a parameter of the compensation network based on the comparison of the monitored output current to the first current reference; and switching a second resistor of the compensation network of the error amplifier in or out of the compensation network to change a parameter of the compensation network based on the comparison of the monitored output current to the second current reference, the second resistor being switched in or out of the compensation network separately from the first resistor.

11. The method of claim 10 wherein the first current reference comprises a constant current source.

12. The method of claim 10 wherein switching the first resistor of the compensation network of the error amplifier in or out of the compensation network comprises:

developing a control signal to close or open a switch across the first resistor.

13. The method of claim 10 further comprising:

switching a capacitor of a compensation network of the error amplifier in or out of the compensation network to change a parameter of the compensation network based on the comparison of the monitored output current to the first current reference.

14. The method of claim 10 further comprising:

switching a third resistor of the compensation network of the error amplifier in or out of the compensation network to change the parameter of the compensation network.

15. An error amplifier of a low dropout regulator, the error amplifier comprising:

a first amplifier stage configured to compare a monitored voltage output of the low dropout regulator with a reference voltage;

a second amplifier stage coupled to an output of the first amplifier stage; and a compensation network coupled to the second amplifier stage, the compensation network including a plurality of switches configured to be opened and closed to change a parameter of the compensation network based on a load current provided by the low dropout regulator to a load, wherein the compensation network comprises a plurality of resistors that are serially connected, each resistor in the plurality of resistors having across it a switch in the plurality of switches.

16. The error amplifier of claim 15 wherein the first amplifier stage comprises a differential amplifier.

17. The error amplifier of claim 15 wherein the compensation network is across an input and an output of the second amplifier stage in a Miller connection.

18. The error amplifier of claim 15 further comprising:

a current monitoring and control circuit configured to control opening and closing of switches in the plurality of switches based on the load current.

19. The error amplifier of claim 18 wherein the current monitoring and control circuit includes a plurality of current sense blocks each configured to drive a corresponding switch in the plurality of switches to adapt the error amplifier to varying load currents.

* * * * *